United States Patent [19]

Lewis Jr.

[11] Patent Number: 4,696,519

[45] Date of Patent: Sep. 29, 1987

[54] FILAMENT STOCK BOX AND PICKING APPARATUS

[75] Inventor: John C. Lewis Jr., Salisbury, Vt.

[73] Assignee: Tucel Industries Inc., Forest Dale, Vt.

[21] Appl. No.: 838,549

[22] Filed: Mar. 11, 1986

[51] Int. Cl.[4] ..... A46D 1/08

[52] U.S. Cl. ..... 300/7; 300/21

[58] Field of Search ..... 300/2-11, 300/21; 15/159 R

[56] References Cited

U.S. PATENT DOCUMENTS 2,043,758 6/1936 Lay ..... 15/159 R 3,471,202 10/1969 Lewis ..... 300/7 X

*Primary Examiner*—Mark Rosenbaum

*Attorney, Agent, or Firm*—Lowe, Price, LeBlanc, Becker & Shur

[57] ABSTRACT

This invention relates to new and useful brush and broom manufacturing apparatus which allows the manufacture of a wide variety of different type constructions having pretrimmed synthetic brush tufts fused onto a thermo plastic or foreign substrate whereby the tufted construction is comprised of at least two different types of thermo plastic monofilament, said different tufts being fused simultaneously onto the said substrate. A different stock box is provided for each type of filament. A picking unit with individual pickers for each tuft is also provided. Picker receiving apertures corresponding to the unit are provided in each box, but cut-to-length filament are blocked from the area behind predetermined apertures so that the unit picks tufts only from unblocked apertures.

12 Claims, 13 Drawing Figures

FILAMENT STOCK BOX AND PICKING APPARATUS

This invention relates to new and useful brush making machinery for continuously fabricating synthetic filament constructions. The apparatus is particularly adopted to form a wide variety of filament constructions wherein the ends of the filament are fused and supported prior to cooling, so that the cooled, pre-fused ends of the tufts are supported by and radiate from the surface of a substrate.

The apparatus of this invention is intended to simultaneously fuse at least two different cut-to-length thermo plastic monofilament tufts, whereby a brush or broom construction can have tufts of two different stiffnesses and/or colors. In fact, it is possible to produce a push broom having a leading front row of very stiff filament tufts of a shorter length than a trailing row of very soft filament tufts of a longer length and whereby the filament tufts are comprised of large diameter polypropylene filament in the front row tufts and lesser diameter polypropylene filament in the trailing row tufts. U.S. Pat. Nos. 3,471,202; 3,799,616; 3,910,637; 4,009,910; 4,109,965 and 4,189,189 disclose my improved tufting apparatus for picking and fusing cut-to-length synthetic monofilament and the disclosures of these above mentioned patents are hereby incorporated by reference.

U.S. Pat. No. 2,043,758, however, discloses a broom comprising two different types of natural fibers with a leading row of stiff bristle and a trailing row of finer bristle which can only be made by hand or by employing the use of stapling equipment whereby one bristle tuft is inserted into the brush block at a time.

The improved devices of this instant invention, while similar in appearance to devices in the above-mentioned patent, have an additional capability. The picking unit of this invention can pick, trim and fuse all the required filament for a single brush or broom construction having at least two different filaments-type tufts.

It will be obvious to those skilled in the art of brush making that a wide variety of different filament tufted brush constructions may be manufactured employing the apparatus of this invention.

Accordingly, it is therefore an object of this invention to provide new and useful brush making apparatus adaptable for use in forming a construction whereby two different filament lengths are assembled in one picking unit.

Another object of this invention is to provide a brush making apparatus adaptable for use in forming a construction whereby two different filament lengths are assembled in one picking unit.

Another object of this invention is to provide a brush making apparatus adaptable for use in forming a construction whereby two different diameter filament tufts comprising different monofilament diameters are assembled in one picking element.

It is a further object of this invention to provide brush and broom manufacturing apparatus for use in tufting broom constructions whereby one picking element comprises at least two different tuft forming adaptations.

These and other objects will become more readily apparent with references to the appended drawings and following description wherein.

Figure 1:
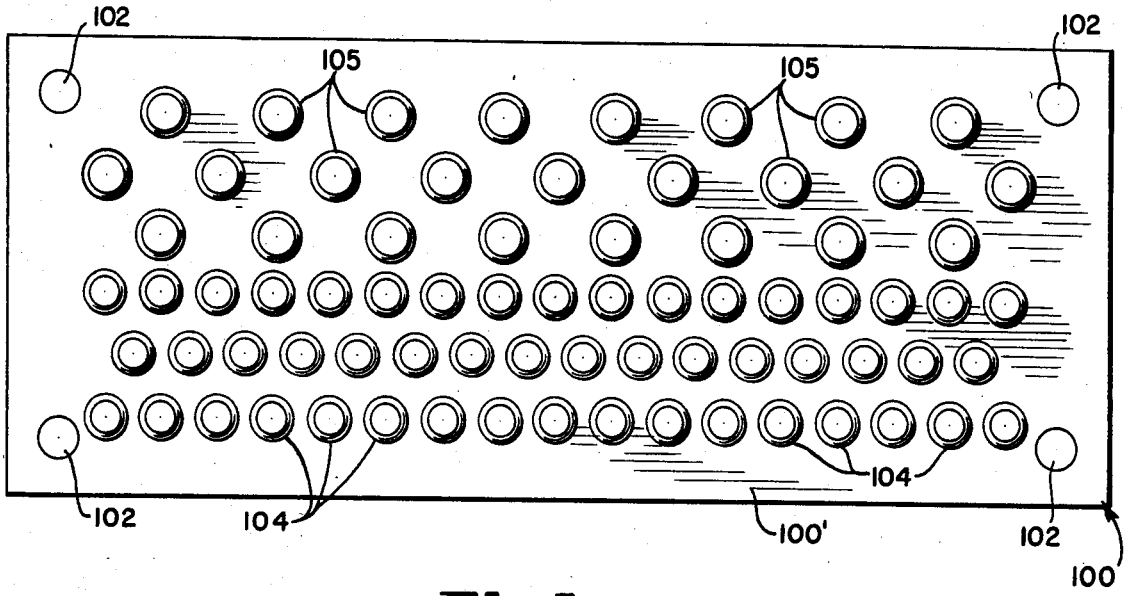
FIG. 1 is a front view of a tuft forming picker means for tufting and entire broom in accordance with this invention.
Figure 2:
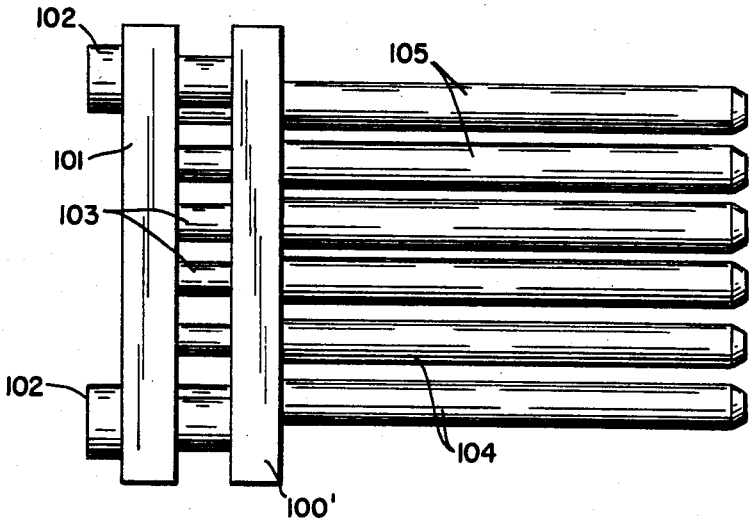
FIG. 2 is a side view of the tuft forming picker of FIG. 1.

In order to describe this invention more fully, reference is now made to specific embodiments illustrated in the drawings. This invention is directed to production of houseware type as well as professional type brushes and brooms wherein tufted constructions are fused simultaneously having at least two different types of filaments. The novel and new features of this invention can be best described by referring to FIGS. 1–5.

Figure 3:
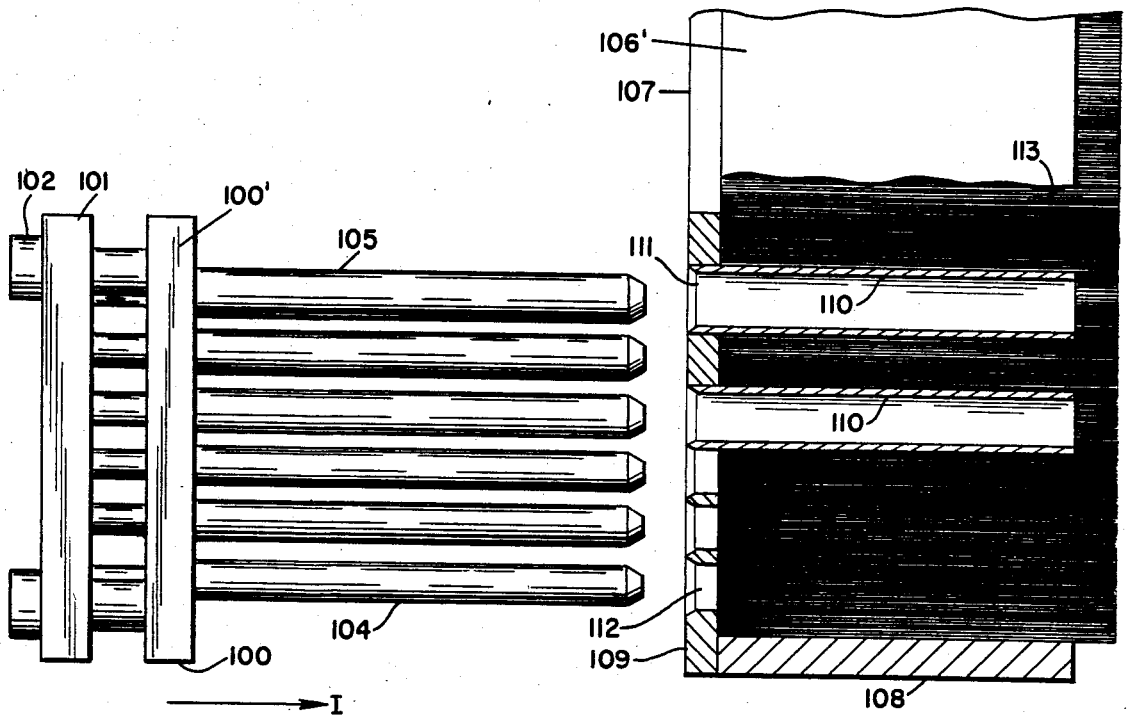
FIG. 3 is a side view of the tuft forming picker of FIG. 1 prior to indexing into a filament stock box with a portion of the side removed and containing a single type of filament.
Figure 4:
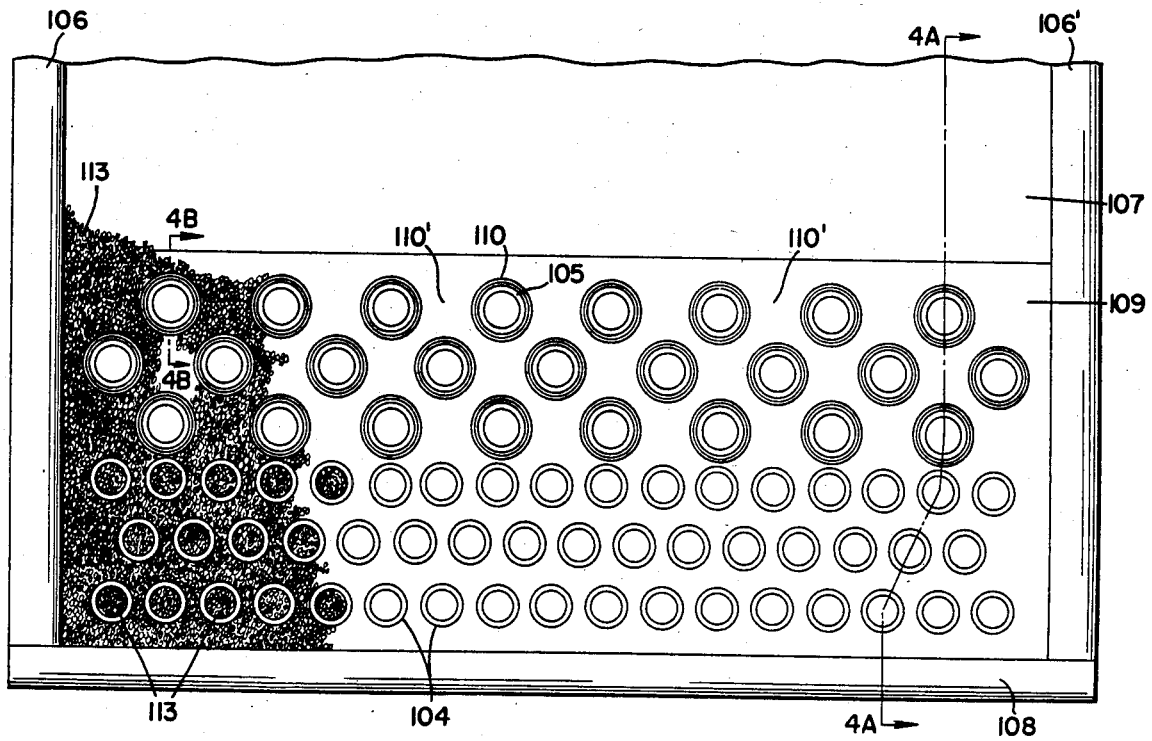
FIG. 4 is a fragmentary back view of the filament stock box shown in FIG. 3 with a portion of the filament removed and with the picking device indexed into the stock box.

The tuft forming picking device 100 shown in FIG. 1 is comprised of hollow picking tubes 104 and 105 mounted in plate 100' with trimming pins 103 held between plate 101 and 100'. Guide pins 102 keep the picking plates together. When indexing the picking device into a filament stock box, all the picking tubes 104 and 105 must enter, however, in this instant invention, only the picker tubes 104 are to be filled with a first type of synthetic filament. In order to accomplish this a special stock box 106 is provided, as shown in FIGS. 3 and 4. The filament stock box of FIG. 3 is shown with sides 106', front 107 and bottom 108, wherein there is mounted a front aperture face 109 containing apertures 111 and 112 in the same design as the tuft picking device 100. The apertures 111 and 112 accept the picking tubes 104 and 105 of picker device 100 as it indexes in direction I, as shown in FIG. 3. The picker tubes 105 remain empty because they enter hollow tubes 110 through apertures 111. Picker tubes 104 will enter aperture 112 and engage filament 113 as contained in the filament stock box 106.

As is illustrated in FIG. 4, the picking tubes 104 having entered through apertures 112 are filled with filament 113. The filament 113 in the area of aperture 112 was allowed to flow downward through the stock box and in between hollow tubes 110 in the space 110' created between each hollow tube 110. As also shown in FIG. 4, the picking tubes 105 have entered hollow tubes 110 and do not engage filament 113.

Figure 4A:
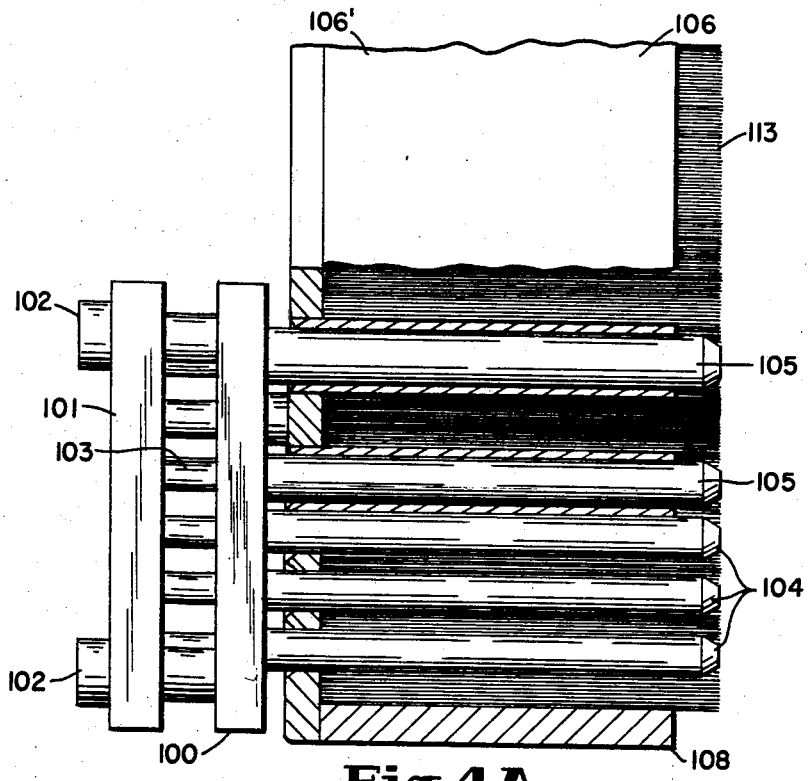
FIG. 4A is a view of the tuft forming picker indexed into the filament stock box as taken along line A—A of FIG. 4.
Figure 4B:
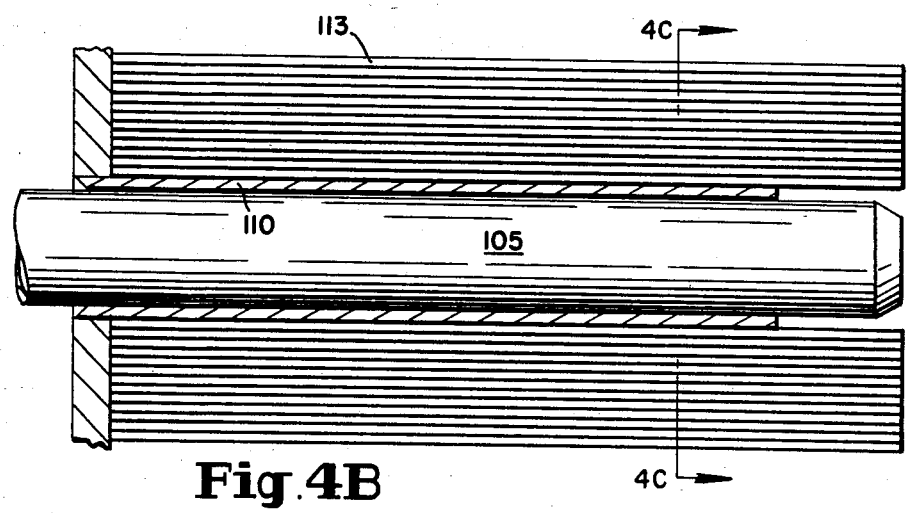
FIG. 4B is a fragmentary view of one tuft forming picker tube contained within a portion of the stock box as taken along line B—B of FIG. 4A.
Figure 4C:
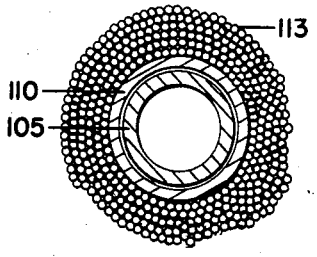
FIG. 4C is a fragmentary view of the tuft forming picker tube taken along C—C of FIG. 4B.

Referring specifically to FIGS. 4A, B and C, picking tubes 104 and 105 have entered the filament stock box 106. All picking tubes 104 and 105 have come to as stop at the same point. FIG. 4B illustrates that the picking tube 105 has entered hollow tube 110 and has not come into contact with filament 113, even though filament 113 is completely surrounding hollow tube 110. Also, as further shown in FIG. 4C, picking tube 105 is empty and contains no filament 113, and filament 113 completely surrounds hollow tube 110.

Upon withdrawal of picking device 100, from filament stock box 106, only a portion of picking device 100 will be filled with filament; picker tubes 104 are filled with filament 113, while picker tubes 105 are empty.

Figure 5:
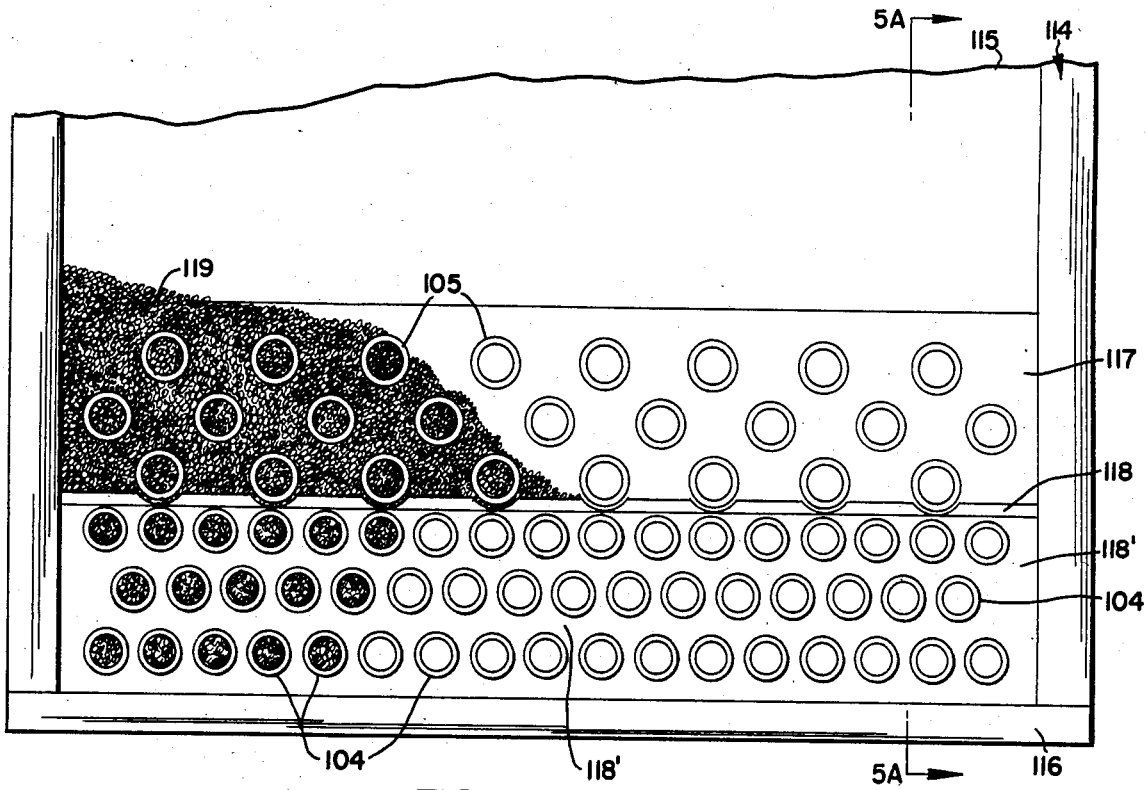
FIG. 5 is a fragmentary rear view of a second filament stock box containing a second type of filament with the picking device of FIG. 1 indexed within the stock box.
Figure 5A:
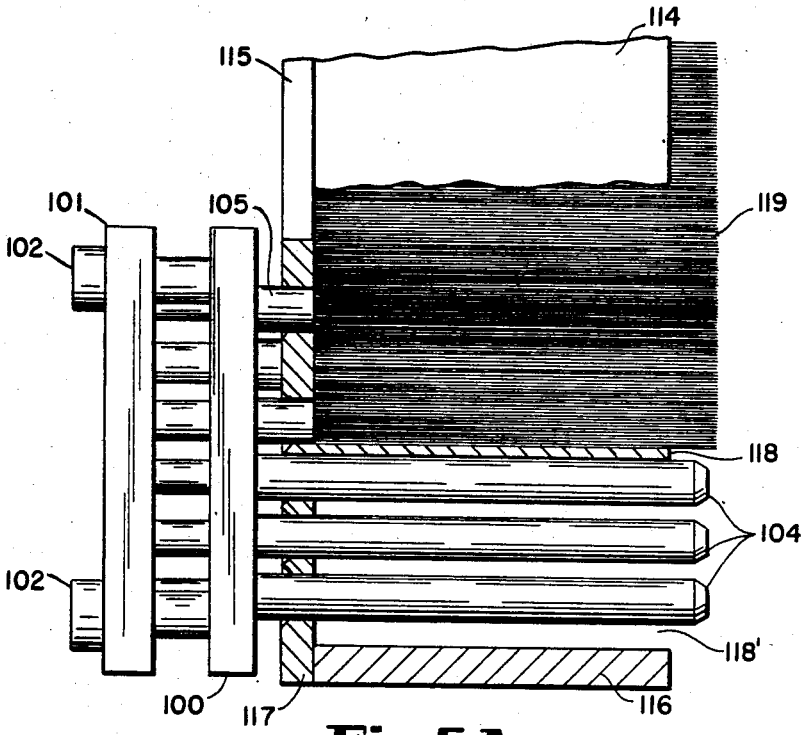
FIG. 5A is a view of the tuft forming picker of FIG. 1 indexed into the second filament stock box as taken along line A—A of FIG. 5.

A second filament stock box 114 is then provided. Box 114 include sides 114', front 115 and bottom 116, as well as aperture plate 117 containing the identical tuft design as the picking device 100. When the picking device 100 is indexed through the front aperture plate 117 as illustrated in FIGS. 5 and 5A, the previously filled picker tubes 104 containing filament 113, are allowed to enter into an empty space 118' as created by separator 118 which extends across the inside of the filament stock box 114 and supports filament 119 opposite the apertures which correspond to the picking tubes 105 on the picking device 100. As the picking device 100 enters the second stock box 114, the picking tubes 105 engage filament 119 and fill with said filament 119. Thus the picking device 100 now contains picking tubes 104 filled with filament 113 and picking tubes 105 filled with filament 119 and picking tubes 105 filled with filament 119. Filament 113 is different than filament 119, and therefore the picking tubes now contain two different filaments which can be subsequently fused onto a substrate to create a brush or broom construction. Filament 113 may differ from filament 119 in diameter, stiffness, color or the like. By providing stock boxes containing two different filament lengths, it is also possible to pick and fill a picking device with filaments which when said filaments are fused, will yield filament tufts having a different trim (length).

It is also possible to combine different filament tufts at any position on the filament tuft picking device by providing hollow tubes as separators and spaces located within at least two different stock boxes.

Figure 6:
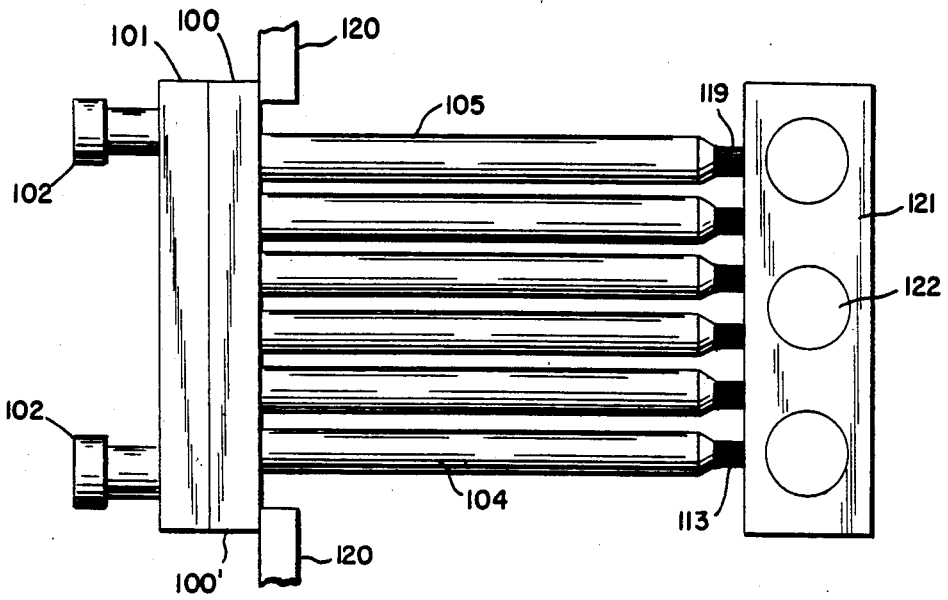
FIG. 6 is a fragmentary side view of the tuft forming picker of FIG. 5A as withdrawn from the second filament stock box with the picking tube support and trim ends in a closed attitude and filament ends fused against a melter block.
Figure 7:
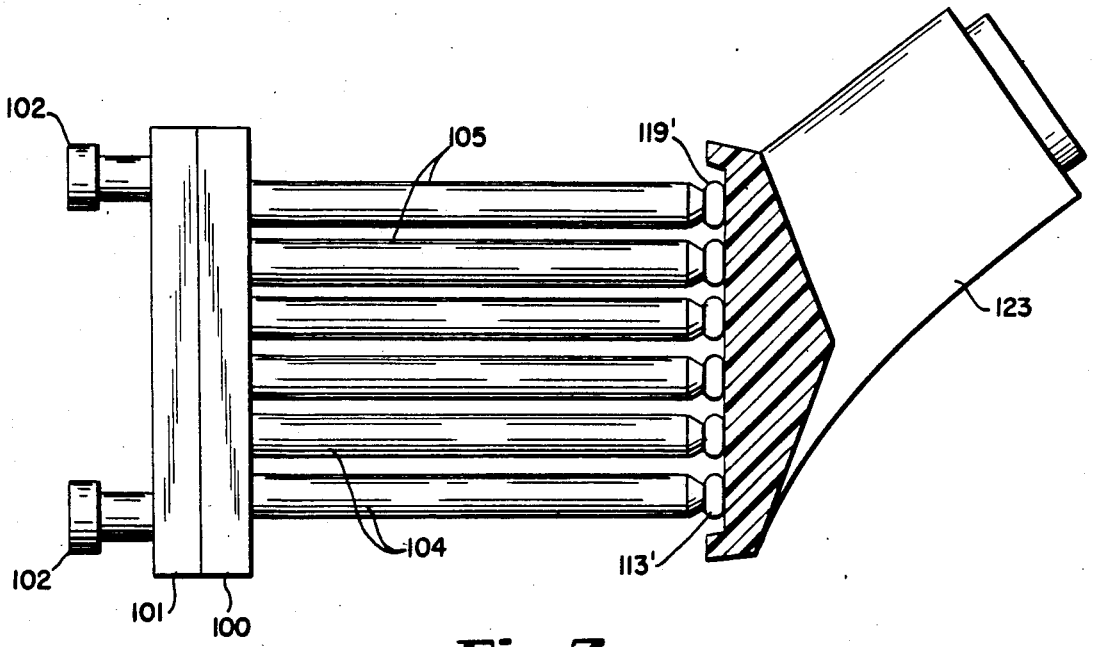
FIG. 7 is a fragmentary side view of the tuft forming picker of FIG. 6 in the fusing attitude.
Figure 8:
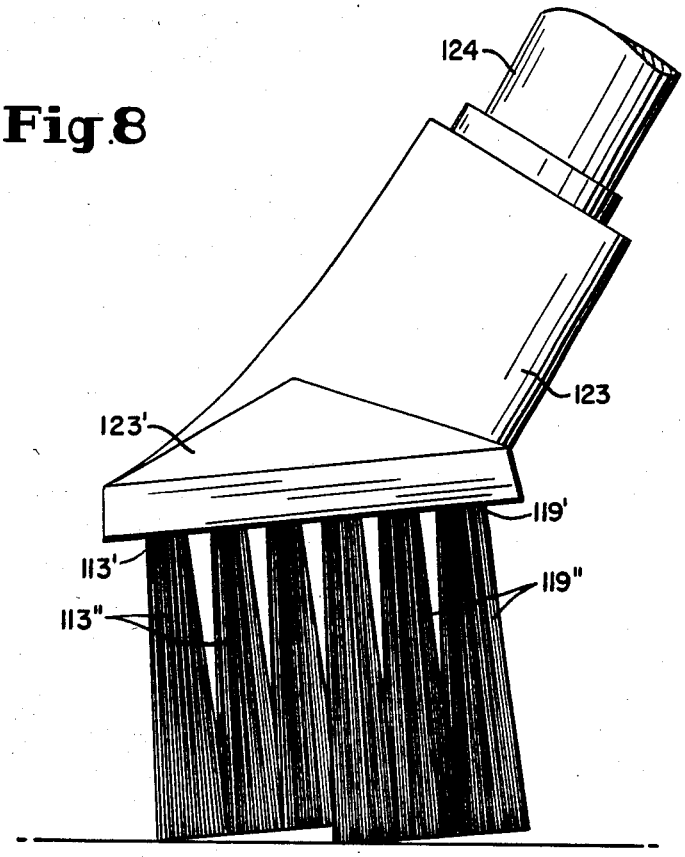
FIG. 8 is a fragmentary side view of a tufted article made in accordance with this invention.
Figure 9:
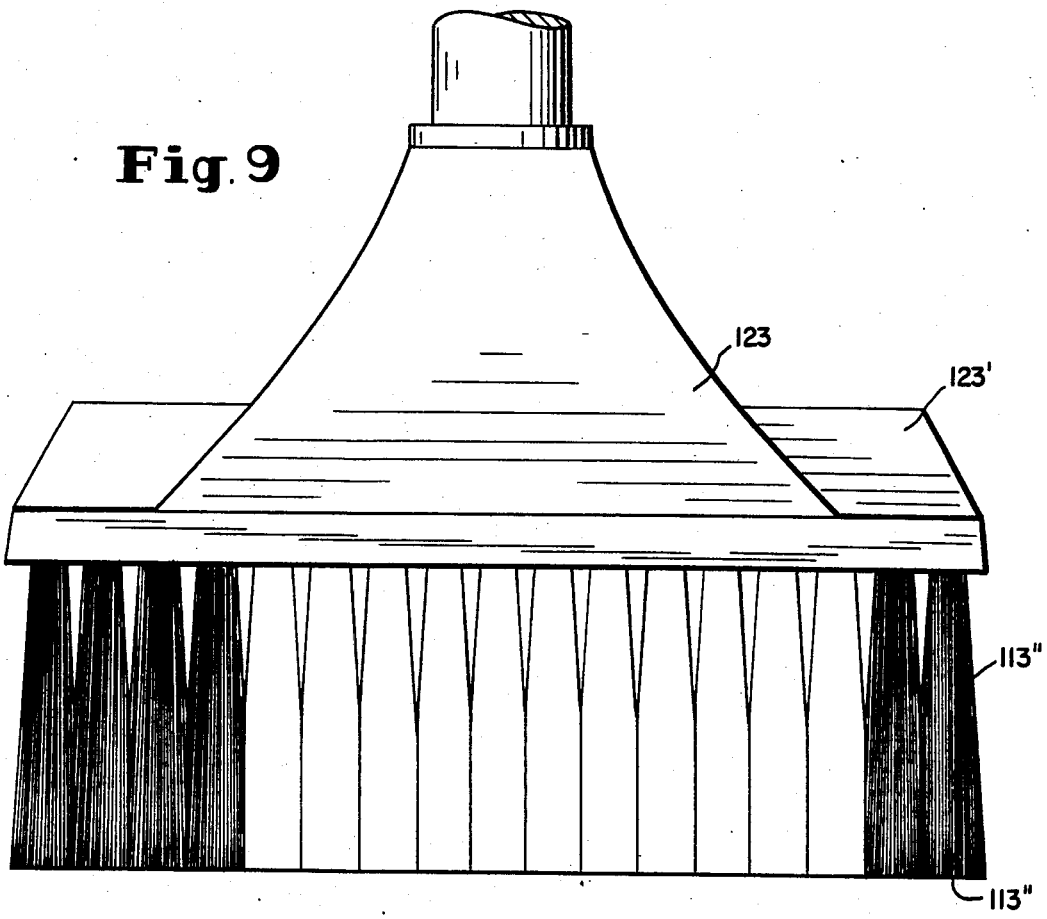
FIG. 9 is a front view of the tufted article of FIG. 8.

Now referring to FIG. 6, the tuft picking device 100 is then indexed into a filament melter block 121 containing cartridge heaters 122. The picking device is then closed by closing the plates 100' and 101 together, to expose the tuft ends. The exposed ends of filaments 113 and 119, extending from picking tubes 104 and 105, respectively, are then pushed onto the hot melter plate 121. The ends of the filaments 113 and 119 then fuse. The fused filament ends 113' and 119' are then indexed onto a thermo plastic substrate 123 as illustrated in FIG. 7, whereby the pre-fused ends 113' and 119' are allowed to fuse to the substrate 123 and cool. Upon withdrawal of the picking device 100, a tufted broom 123' is produced, as illustrated in FIGS. 8 and 9. The substrate 123 or block shown has three rows each of filaments 113 and 119 in the form of tufts. The front row of tufts 113" are shorter than the back row of tufts 119". The filament tufts 113" and 119 are therefore different.

An example of the different could be as follows:

The front row of tufts may be comprised of a stiff, 0.024 - "x" shaped diameter brown crimped filament, and the back row of tufts comprises a soft, 0.012 - "x" shaped diameter black level filament having a length one-quarter of an inch longer than the front row filament, whereby a broom results with the ability to push heavy grit-like particles forward and the trailing back row filament tufts able to pick up and move along the small, fine particles so that in one complete pass of the broom over particles, all of the particles are carried forward.

The hollow separator tubes and shelf separators can be constructed in any shape, length and/or size to accept the picking device in order that brush construction can be obtained whereby at least two different filament types are incorporated simultaneously onto a substrate.

It has been found that the picking device of this invention will pick tufts from assembled parallel cut-to-length synthetic filament having any cross-sectional configuration, such as circular, x-shaped, star-shaped, hollow and the like. The diameter of the filament picked ranges from 0.005 inches to at least 0.250 inches. The lengths of the cut-to-length filament can range from about 0.5 up to 30 inches. The composition of the synthetic filament picked and assembled into filament tufts is not limited, and thermo plastic filaments whether oriented or unoriented can be used to form tufts in accordance with this invention. Polymers such as polyamide, polypropylene, polyethylene, copolymers from polypropylene and ethylene, polyfluoride, and the like may be employed.

This invention may be embodied in other specific forms without departing from the spirit or essential characteristics thereof. The present embodiments are therefore to be considered in all respects as illustrative and not restrictive, the scope of the invention being indicated in the appended claims rather than by the foregoing description, and all changes which come within the meaning and range of equivalency of the claims are therefore intended to be embraced therein.

What is claimed and desired to be secured by United States Letters Patent is:

1. In an apparatus for making tufted, fused constructions of at least two different types of synthetic cut-to-length filament tufts including means for picking said tufts including at least two hollow picking tubes, means for simultaneously heat sealing and pre-fusing the non working ends thereof and means for simultaneously fusing said pre-fused ends onto a substrate, the improvement comprising:

at least two stock boxes, each containing a different type of filament, each box having a face with apertures therethrough disposed to register with and to receive said picking tubes, the filament therein being oriented longitudinally perpendicular to said face; and filament blocking means disposed within each stock box for vacating an area of filament behind at least one of said apertures so that when the picking tubes enter the apertures at least one of said tubes will not pick a tuft, and at least one of said tubes will pick a tuft of filament.

2. The apparatus of claim 1 wherein said blocking means comprises at least one hollow tube having a minimum cross sectional dimension greater than that of at least one of said apertures and disposed to surround said aperture and extend into said box perpendicularly to the face.

3. The apparatus of claim 1 wherein said blocking means comprises a divider plate disposed within said box and extending perpendicularly to the face thereof, said plate disposed to separate an area behind at least one aperture from the filament containing interior of said box.

4. The apparatus of claim 1 wherein the face has at least one lower row of a plurality of apertures and at least one upper row of a plurality of apertures and said picking means picks a different type of filament for the lower row than for the upper row.

5. The apparatus of claim 4 wherein two stock boxes are provided.

6. The apparatus of claim 1 wherein said filament types differ in length.

7. The apparatus of claim 1 wherein said filament types differ in stiffness.

8. The apparatus of claim 1 wherein said filament types differ in cross-sectional configuration.

9. The apparatus of claim 1 wherein said filament types differ in color.

10. A method for simultaneously forming a brush construction having tufts of at least two different types of cut-to-length synthetic filament comprising providing a picker having at least two hollow picking elements for forming said tufts, said elements disposed in a predetermined array;

providing at least two stockboxes each containing a different type of cut-to-length synthetic filament, each box having a faceplate with apertures therein adapted to receive the picking elements therethrough;

indexing said elements successively into each of said stock boxes, through the apertures and picking at least one tuft of filament only with a predetermined at least one of the elements until said elements have picked tufts of each of said different types of filament;

prefusing the ends of said tufts simultaneously;

providing a brush back and simultaneously mounting said prefused ends thereon to form the brush construction.

11. The method of claim 10 wherein at least two rows of elements are provided in the array and at least one of said rows consists of elements adapted to pick tufts different from those picked by elements in at least one other row.

12. The method of claim 10 further comprising indexing at least one of said elements into at least one stockbox with a tuft of filament contained therein.

* * * * *